US007159411B2

(12) United States Patent
Chae et al.

(10) Patent No.: US 7,159,411 B2
(45) Date of Patent: Jan. 9, 2007

(54) REFRIGERATOR

(75) Inventors: Jong-eun Chae, Kwangju (KR); Eun-mog Yang, Kwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 118 days.

(21) Appl. No.: 10/823,742

(22) Filed: Apr. 14, 2004

(65) Prior Publication Data

US 2004/0221605 A1 Nov. 11, 2004

(30) Foreign Application Priority Data

May 9, 2003 (KR) ..... 10-2003-0029475

(51) Int. Cl.
*F25D 23/12* (2006.01)

(52) U.S. Cl. ..... 62/259.2

(58) Field of Classification Search ..... 62/259.2, 62/440, 448

See application file for complete search history.

(56) References Cited

U.S. PATENT DOCUMENTS 5,419,148 A 5/1995 Kuehl et al.

FOREIGN PATENT DOCUMENTS

| | | |
|---|---|---|
| JP | 8-94244 | 4/1996 |
| JP | 9-324983 | 12/1997 |
| JP | 11-118348 | 4/1999 |
| JP | 11-201634 | 7/1999 |
| JP | 11-211321 | 8/1999 |
| JP | 11-211343 | 8/1999 |
| JP | 2001-50651 | 2/2001 |
| JP | 2002-162158 | 6/2002 |
| JP | 2003-28566 | 1/2003 |
| KR | 1999-32472 | 7/1999 |
| KR | 1999-32472 U | 7/1999 |

OTHER PUBLICATIONS

Chinese Office Action for Application No. 200410039727.7.

*Primary Examiner*—Melvin Jones
(74) *Attorney, Agent, or Firm*—Staas & Halsey LLP

(57) ABSTRACT

A refrigerator having a main body with storing compartments, and doors to open and close openings of the respective storing compartments in a first side of the main body, has: a box accommodating part concaved from the first side of the main body; and an electric component box, which is drawn in and out of the box accommodating part, and includes electric components. With this configuration, the present invention provides the refrigerator allowing the electric component box to be easily drawn in and out and inspected.

18 Claims, 6 Drawing Sheets

REFRIGERATOR

CROSS-REFERENCE TO RELATED APPLICATIONS

This application claims the benefit of Korean Application No. 2003-29475, filed May 9, 2003, in the Korean Intellectual Property Office, the disclosure of which is incorporated herein by reference.

BACKGROUND OF THE INVENTION

1. Field of the Invention

The present invention relates to a refrigerator, and more particularly to a refrigerator having an improved electronic component box, and an improved mounting structure thereof.

2. Description of the Related Art

Conventionally, a refrigerator comprises a main body with storing compartments, such as a refrigerator compartment and a freezer compartment, a cool air generating part provided in the main body and generating a cooling air, and doors to open and close openings of the storing compartments.

The conventional refrigerator further comprises an electric component box accommodating electric components, such as a circuit board, to supply power to the refrigerator and control the refrigerator.

According to the conventional refrigerator, a rectangular parallelepiped electric component box having a circuit board, etc. is provided at a component compartment in a lower part of the main body of the refrigerator. A separating plate separating the interior of the electric component unit is provided. The circuit board is provided on one side of the separating plate, and electric components and bundled lines are provided on an other side of the separating plate.

But according to the conventional refrigerator, the electric component box is provided in the interior of the component compartment, and when a user wants to inspect the electric component box, he/she has to move the refrigerator, and inspect the electric component box through a rear of the refrigerator. Accordingly, it is not easy to inspect the electric component box.

SUMMARY OF THE INVENTION

It is an aspect of the present invention to provide a refrigerator with an electric component box thereof that is easily inspected.

Additional aspects and/or advantages of the invention will be set forth in part in the description that follows, and, in part, will be obvious from the description, or may be learned by practice of the invention.

To achieve the above and/or other aspects, there is provided a refrigerator having a main body with storing compartments, and doors to open and close respective openings of the storing compartments in a first side of the main body, the refrigerator comprising a box accommodating part concaved from the first side of the main body; and an electric component box which is drawn in and out of the box accommodating part and includes electric components.

According to an aspect of the invention, the box accommodating part is provided in a lower part of the main body.

According to an aspect of the invention, the refrigerator further comprises a box supporting bracket provided in the box accommodating part and supporting the electric component box, so that the electric component box is drawn in and out of the box accommodating part.

According to an aspect of the invention, the electric component box comprises projection parts, provided in opposite ends of the electric component box, and the box supporting bracket comprises guide parts accommodating and guiding the projection parts.

According to an aspect of the invention, the electric component box comprises: a case having an accommodating space, in which to mount the electric components, with a top of the case being open; and a cover engaged to the top of the case.

According to an aspect of the invention, the case comprises a component mounting part having the accommodating space, in which to mount the electric components; and a drainage part provided adjacent to the component mounting part and having at least one drainage passage.

According to an aspect of the invention, the cover covers the component mounting part, and at least one concavity, positioned in an upper part of the cover, defines a drainage way.

According to an aspect of the invention, the case further comprises a partition wall provided between the component mounting part and the drainage part, and the cover further comprises a partition wall accommodating part to accommodate the partition wall and prevent a water leakage from the drainage part to the component mounting part.

According to an aspect of the invention, the partition wall and the partition wall accommodating part have screw holes, and the cover is engaged to the case by screwing screws into the respective screw holes, the partition wall accommodating part being engaged with the partition wall.

BRIEF DESCRIPTION OF THE DRAWINGS

These and/or other objects and advantages of the present invention will become apparent and more readily appreciated from the following description of the embodiments, taken in conjunction with the accompany drawings, of which.

DETAILED DESCRIPTION OF THE PREFERRED EMBODIMENTS

Figure 1:
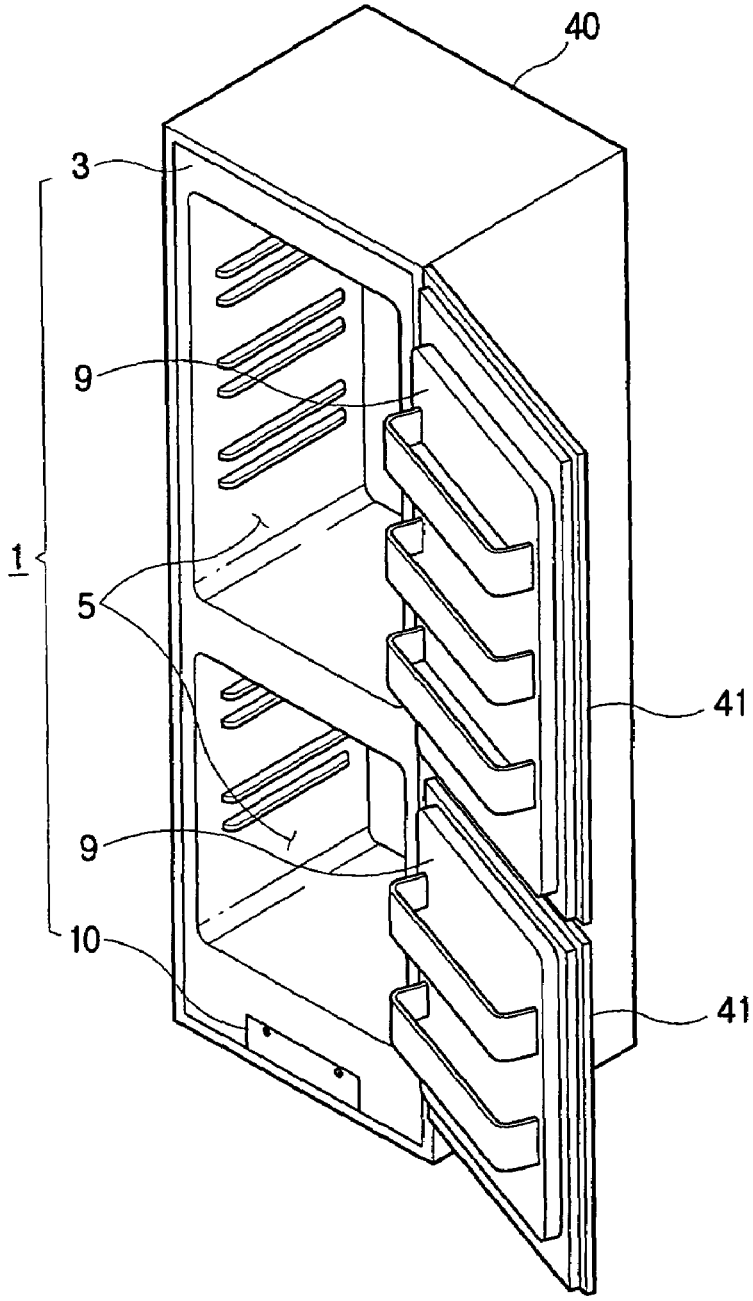
FIG. 1 is a perspective view of a refrigerator according to one embodiment of the present invention.
Figure 2:
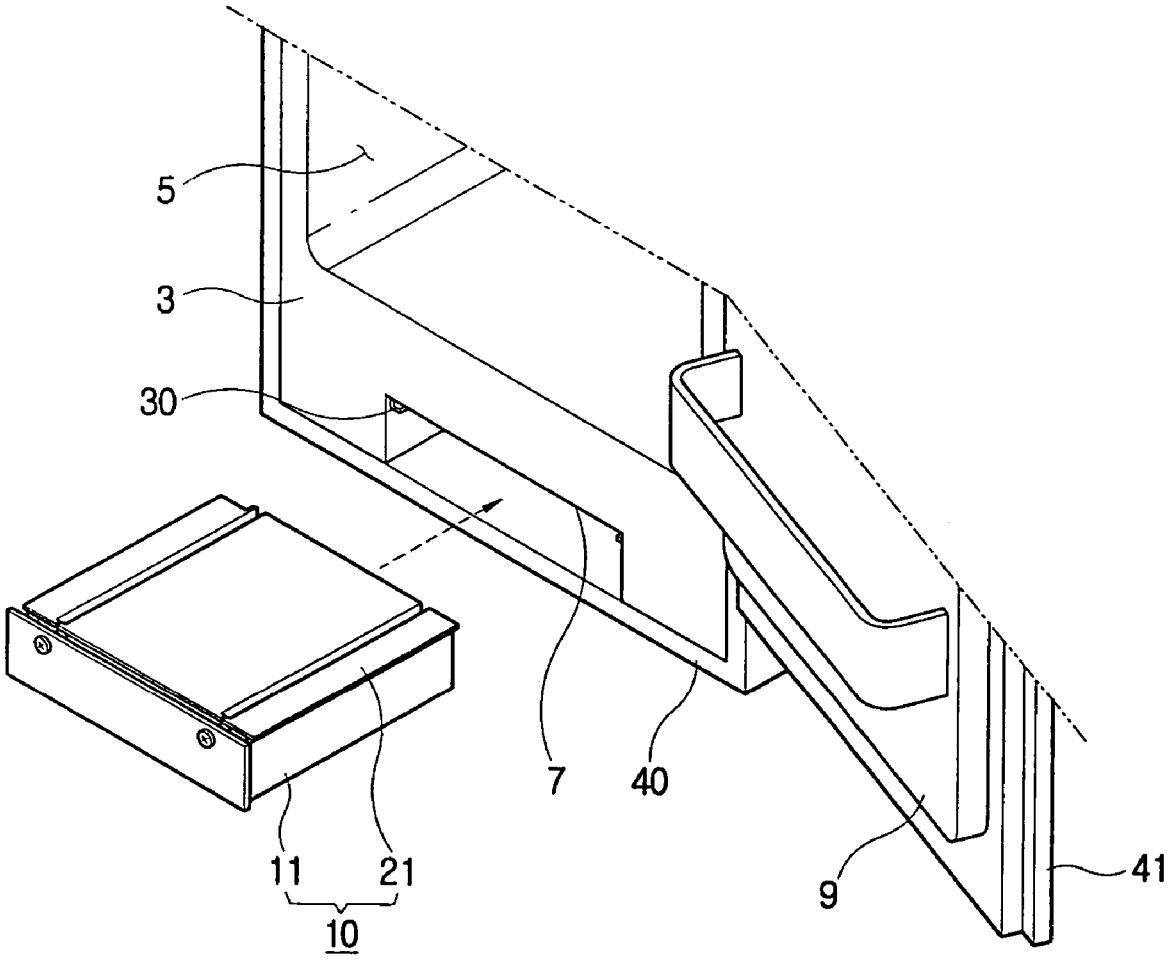
FIG. 2 is a partially enlarged perspective view of the refrigerator of FIG. 1.
Figure 3:
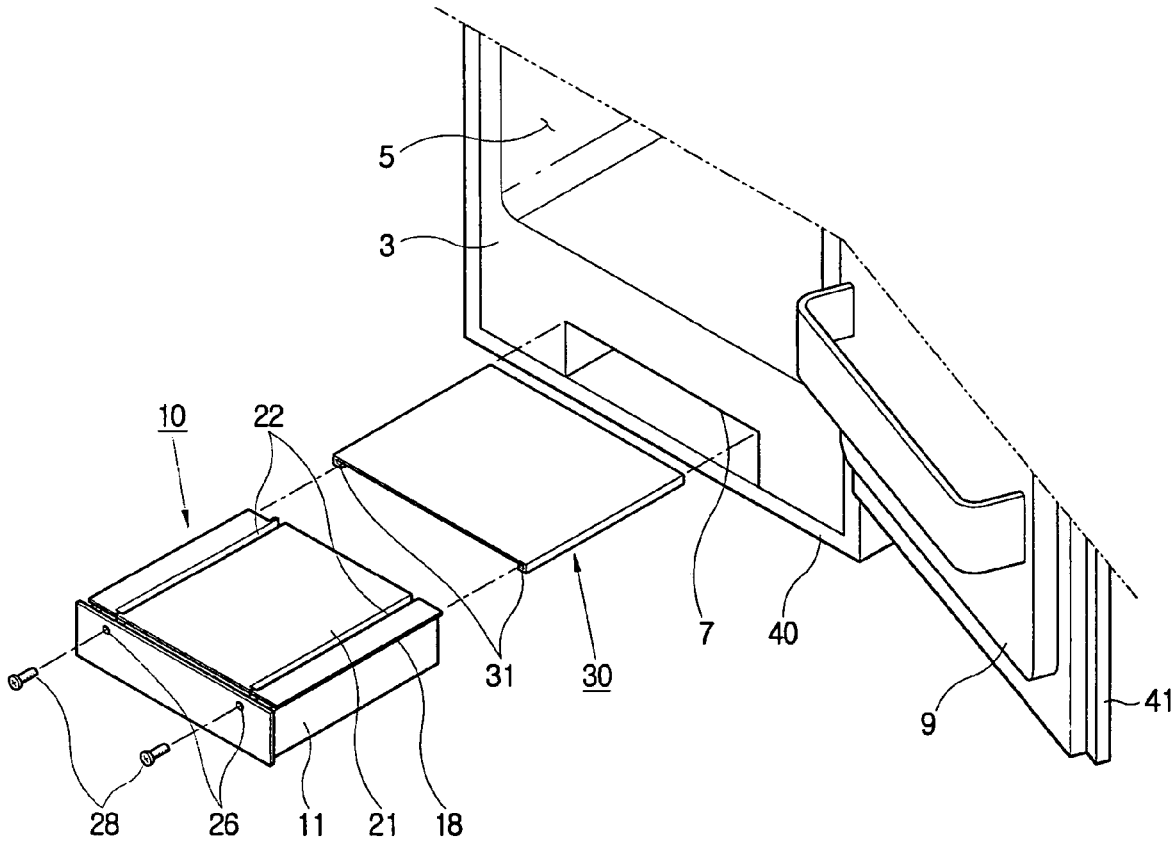
FIG. 3 is a partially exploded perspective view of the refrigerator of FIG. 1.
Figure 4:
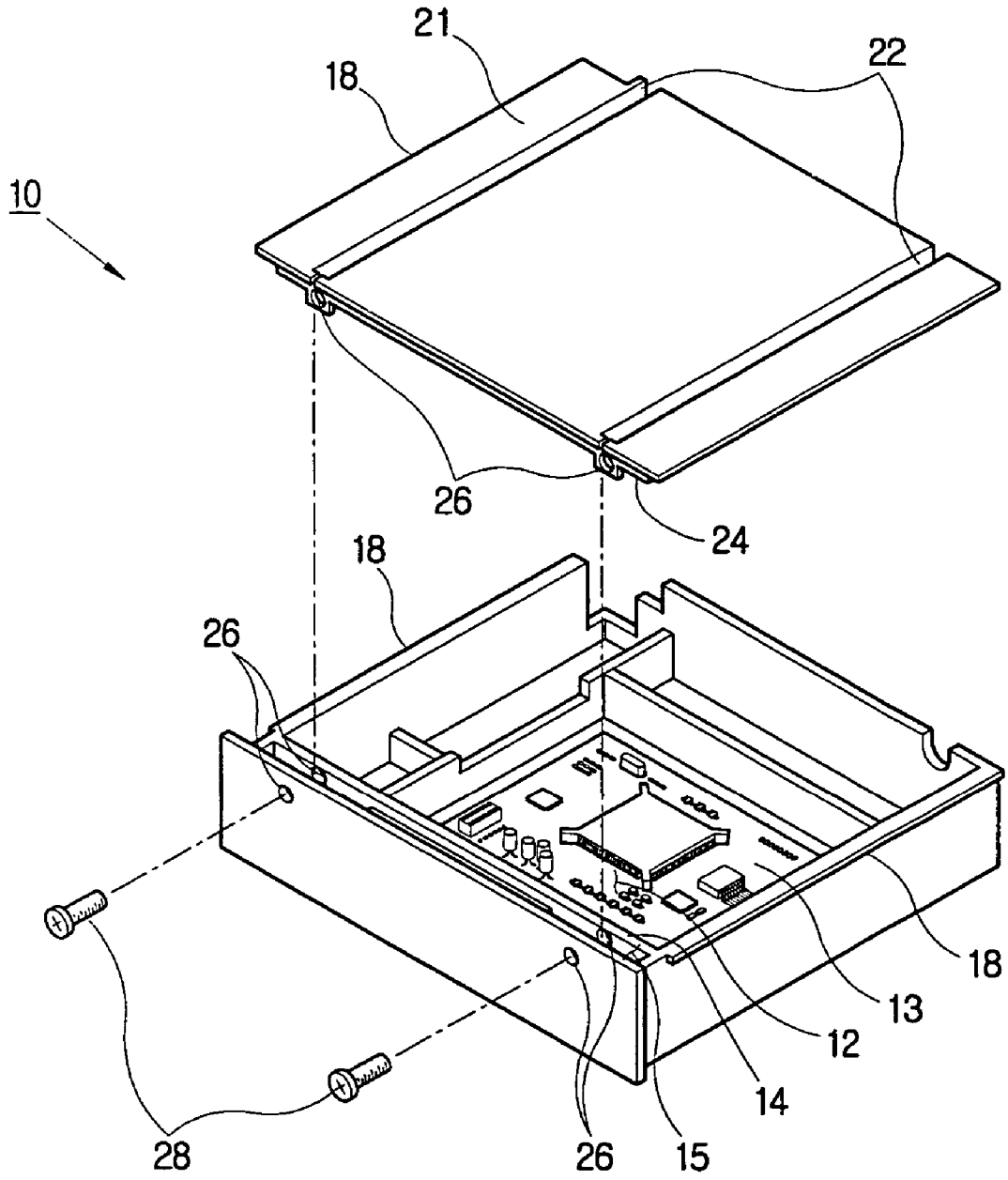
FIG. 4 is an exploded view of an electric component box of FIG. 1.
Figure 5:
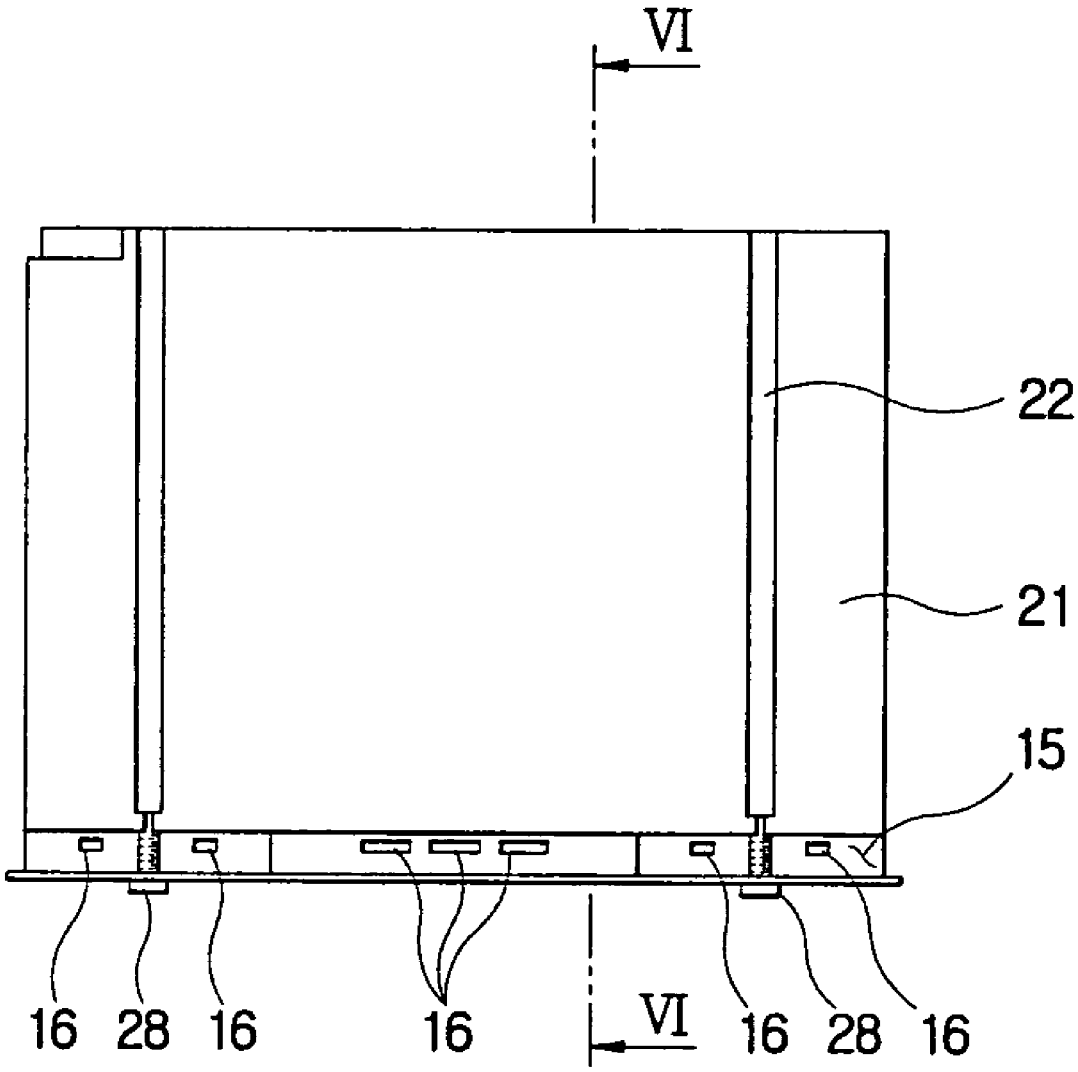
FIG. 5 is a plan view of the electric component box of FIG. 4.
Figure 6:
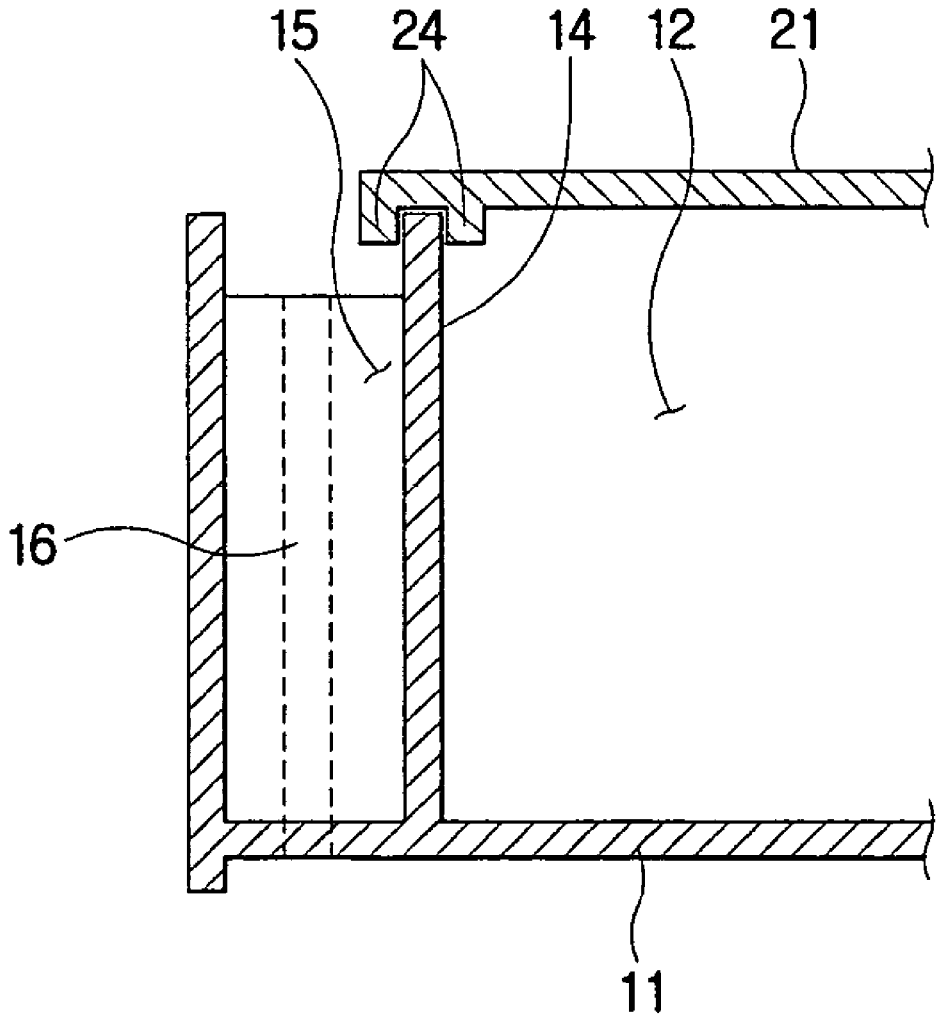
FIG. 6 is a sectional view of the electric component box of FIG. 4, taken along a line VI—VI in FIG. 5.

Reference will now be made in detail to the embodiments of the present invention, examples of which are illustrated in the accompanying drawings, wherein like reference numerals refer to the like elements throughout. The embodiments are described below to explain the present invention by referring to the figures.

As is shown in FIG. 1, a built-in type refrigerator 1 according to an embodiment of the present invention is accommodated into a cabinet 40 with a predetermined accommodating space. The cabinet 40 comprises cover members 41 to open and close respective openings of the accommodating space.

The cover members 41 are rotatably engaged to one side of the cabinet 40, and the insides thereof are engaged to doors 9 (to be described later) of the refrigerator 1. Thus, when the opening of the cabinet 40 is opened and closed by rotation of the cover members 41, the doors 9 engaged to the cover members 41 open and close storing compartments 5 of the refrigerator 1 accordingly.

As is shown in FIGS. 2 through 6, in the refrigerator 1, there is a main body 3 accommodated into the cabinet 40 with the storing compartments 5 to store food, etc. The doors 9 open and close openings of the storing compartments 5 of the main body 3, and a box accommodating part 7 is a recess positioned on a front of the main body 3. The refrigerator 1 also has an electric component box 10, which is drawn in and out of the box accommodating part 7, and includes electric components 13.

The main body 3 is accommodated into the cabinet 40, and comprises the storing compartments 5 for storing food, etc., and a cool air generating part (not shown) to generate cool air and supply the cool air to the storing compartments 5.

The doors 9 are engaged to the cover members 41, and open and close the openings of the storing compartments 5 of the main body 3 by the rotation of the cover members 41.

The electric components 13 are components relating to a power supply part of the refrigerator 1, for example, a controller,, and according to one aspect, comprises a circuit board and cables.

The electric component box 10 comprises a case 11 having an accommodating space to house the electric components 13 with a top thereof opened, and a cover 21 engaged to the top of the case 11. According to one aspect, the electric component box 10 has a rectangular parallelepiped shape to be accommodated into the box accommodating part 7 in the main body 3. The electric component box 10 may have other shapes, such as a cylindrical or polygonal shape.

The case 11 comprises a component mounting part 12 with an accommodating space for mounting the electric components 13, and a drainage part 15 provided adjacent to the component mounting part 12, and having at least one drainage passage 16. According to one aspect, the case 11 further comprises a partition wall 14 provided between the component mounting part 12 and the drainage part 15. According to one aspect, the case 11 is a rectangular parallelepiped shape with the top thereof opened.

According to one aspect, the electric components 13 are screw-engaged to the component mounting part 12.

According to one aspect, the drainage part 15 is provided in front of the component mounting part 12, the partition wall 14 being interposed therebetween, and has a plurality of drainage passages 16 to drain water flowing down from a lower part of the main body 3.

When the water, which condenses on an outside surface of the main body 3 because of a temperature difference between the storing compartments 5 and a cool air supplying part (not shown) of the main body 3, and the outside thereof, the plurality of drainage passages 16 allow the water to drain away from the electric component box 10, to prevent the water from permeating into the component mounting part 12 of the electric component box 10.

The cover 21 is engaged to the top of the component mounting part 12, wherein at least one drainage way 22 is positioned in an upper part of the cover 21. According to one aspect, the cover 21 comprises a partition wall accommodating part 24, accommodating and engaged with the partition wall 14, to prevent a water leakage from the drainage part 15 to the component mounting part 12.

The at least one drainage way 22 is a recess positioned over the component mounting part 12, running in front and rear directions, and allows the water, which condenses on the outside surface of the main body 3 and flows downward, to be drained out without permeating into the component mounting part 12.

The partition wall accommodating part 24 concavely projects downward at a front lower part of the cover 21, and accommodates and is engaged with the partition wall 14 in a concave region thereof, to prevent water leakage from the drainage part 15 to the component mounting part 12.

According to one aspect, screw holes 26, which pass through the partition wall 14 and the partition wall accommodating part 24 in a front and rear direction, are positioned therein. The cover 21 is engaged to the case 11 by screwing screws 28 into the respective screw holes 26, the partition wall accommodating part 24 being engaged with the partition wall 14.

According to one aspect, the box accommodating part 7 is provided in a lower part of the main body 3, and a box supporting bracket 30 is provided in the box accommodating part 7, to support the electric component box 10, wherein the electric component box 10 is drawn in and out, being supported by the box supporting bracket 30.

The box supporting bracket 30 has guide parts 31 guiding projection parts 18 projected from opposite ends of the case 11 of the electric component box 10.

According to one aspect, the projection parts 18 project from opposite ends of the case 11, and at opposite ends of the cover 21. The projection parts 18 may project from the opposite ends of one of the case 11 and the cover 21.

According to one aspect, the guide parts 31 have a "⊏" shape to accommodate and guide the projection parts 18.

Thus, the electric component box 10 of the refrigerator 1, according to one embodiment of the present invention, is easily drawn in and out of the box accommodating part 7 concaved from the front to the rear of the main body 3.

With the above-described configuration, the electric component box 10 of the refrigerator 1 is combined and installed as follows.

The cover 21 is disposed above the component mounting part 12 of the case 11 provided with the electric components 13. The partition wall accommodating part 24 of the cover 21 is inserted over and engaged with the partition wall 14, and then the screws 28 are screwed into the screw holes 26.

The box supporting bracket 30 is engaged to an upper part of the box accommodating part 7. The projection parts 18 of the electric component box 10 are guided by the guide parts 31 of the box supporting bracket 30, to thereby allow the electric component box 10 to be drawn in and out of the box accommodating part 7.

When the electric component box 10 is required to be inspected, the electric component box 10 has only to be drawn out frontward from the box accommodating part 7 of the main body 3. Therefore, a user easily draws out the electric component box 10 and inspects the electric component box 10.

The drainage passages 16 are provided in the case 11, and the drainage ways 22 are provided in the cover 21, so that water flowing through the box accommodating part 7 is drained out without permeating into the component mounting part 12 of the electric component box 10.

Also, the partition wall 14 is-provided between the component mounting part 12 and the drainage part 15 of the case 11, and the partition wall accommodating part 24 that engages the partition wall 14 is provided in the cover 21, so that water leakage from the drainage part 15 to the component mounting part 12 is prevented.

In the above embodiment, the box supporting bracket 30 is provided in the box accommodating part 7 so that the electric component box 10 is drawn in and out of the box accommodating part 7. But a supporting member, not shown, projected from the box accommodating part 7, may support the electric component box 10 instead, so that the electric component box 10 is drawn in and out of the box accommodating part 7.

With the above configuration, the refrigerator 1 according to the present invention allows the electric component box 10 to be easily drawn in and out and inspected by comprising the box accommodating part 7 concaved from the front to the rear of the main body 3 and the electric component box 10 which is drawn in and out of the box accommodating part 7 and includes the electric components 13.

As is described above, the electric component box 10 is easily drawn in and out and inspected. Also, drainage passages 16 and drainage ways 22 are respectively provided in the case 11 and the cover 21 of the electric component box 10, so that water flowing into the box accommodating part 7 is drained out without permeating into the electric component box 10.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A refrigerator having a main body formed with storing compartments, and doors to open and close openings of the respective storing compartments in a first side of the main body, the refrigerator comprising:

a box accommodating part concaved from the first side of the main body; and an electric component box, which is drawn in and out of the box accommodating part, and includes electric components, wherein the box accommodating part is provided in a lower part of the main body.

2. The refrigerator according to claim 1, further comprising:

a box supporting bracket provided in the box accommodating part and supporting the electric component box, so that the electric component box is drawn in and out of the box accommodating part.

3. The refrigerator according to claim 2, wherein:

the electric component box comprises projection parts, provided in opposite ends of the electric component box; and the box supporting bracket comprises guide parts accommodating and guiding the projection parts.

4. The refrigerator according to claim 1, wherein the electric component box comprises:

a case having an accommodating space, in which to mount the electric components, with a top of the case being open; and a cover engaged to the top of the case.

5. The refrigerator according to claim 4, wherein the case comprises:

a component mounting part having the accommodating space, in which to mount the electric components; and a drainage part provided adjacent to the component mounting part and having at least one drainage passage.

6. The refrigerator according to claim 5, wherein:

the cover covers the component mounting part; and at least one concavity, positioned in an upper part of the cover, defines a drainage way.

7. The refrigerator according to claim 5, wherein:

the case further comprises a partition wall provided between the component mounting part and the drainage part; and the cover further comprises a partition wall accommodating part to accommodate the partition wall and prevent water leakage from the drainage part to the component mounting part.

8. The refrigerator according to claim 7, wherein:

the partition wall and the partition wall accommodating part have screw holes; and the cover is engaged to the case by screwing screws into the respective screw holes, the partition wall accommodating part being engaged with the partition wall.

9. The refrigerator according to claim 2, wherein the electric component box comprises:

a case having an accommodating space, in which to mount the electric components, with a top of the case being open; and a cover engaged to the top of the case.

10. The refrigerator according to claim 9, wherein the case comprises:

a component mounting part having the accommodating space, in which to mount the electric components; and a drainage part provided adjacent to the component mounting part and having at least one drainage passage.

11. The refrigerator according to claim 10, wherein:

the cover covers the component mounting part; and at least one concavity, positioned in an upper part of the cover, defines a drainage way.

12. The refrigerator according to claim 10, wherein:

the case further comprises a partition wall provided between the component mounting part and the drainage part; and the cover further comprises a partition wall accommodating part to accommodate the partition wall and prevent a water leakage from the drainage part to the component mounting part.

13. The refrigerator according to claim 12, wherein:

the partition wall and the partition wall accommodating part have screw holes; and the cover is engaged to the case by screwing screws into the respective screw holes, the partition wall accommodating part being engaged with the partition wall.

14. A refrigerator, comprising:

a main body;

a storing compartment provided in the main body;

a door opening and closing the storing compartment;

an electric component box that moves in and out of the main body, to provide access thereto, wherein the electric component box comprises:

a case to house electric components; and a cover, to cover the electric components, wherein the cover comprises projection parts, and the main body comprises a box supporting bracket with guide parts, that engage and guide the projection parts, to move the electric box in and out of the main body.

15. A refrigerator, comprising:

a main body;

a storing compartment provided in the main body;

a door opening and closing the storing compartment;

an electric component box that moves in and out of the main body, to provide access thereto, wherein the electric component box comprises:

a case to house electric components; and a cover, to cover the electric components, wherein the case comprises a component mounting part, to house the electric components, and a drainage part with a drainage passage, to drain condensation from the electric component box.

16. The refrigerator according to claim 15, wherein the cover comprises:

a drainage way, recessed into the cover, to collect the condensation and direct the condensation to the drainage part.

17. The refrigerator according to claim 15, wherein the case comprises:

a partition wall, separating the component mounting part and the drainage part, to prevent the condensation from entering the component mounting part.

18. The refrigerator according to claim 17, wherein the cover comprises a partition wall accommodating part accommodating a first end of the partition wall, to prevent the condensation from entering the component mounting part.

* * * * *